US006070561A

United States Patent [19]

Greene et al.

[11] Patent Number: 6,070,561

[45] Date of Patent: Jun. 6, 2000

[54] VALVE ACTUATOR WITH LUBRICATION PASSAGE AND METHOD OF FORMING

[75] Inventors: Cynthia Ann Greene, Rochester, N.Y.; Shawn Harold Russell, Bristol, Conn.

[73] Assignee: General Motors Corporation, Detroit, Mich.

[21] Appl. No.: 09/235,916

[22] Filed: Jan. 25, 1999

[51] Int. Cl.[7] ..... F01L 1/18; F01M 9/10

[52] U.S. Cl. ..... 123/90.36; 123/90.41; 74/559; 29/888.2

[58] Field of Search ..... 123/90.33, 90.35, 123/90.36, 90.39, 90.4, 90.41, 90.42, 90.43, 90.44, 90.45, 90.46; 74/519, 559; 29/888.2

[56] References Cited

U.S. PATENT DOCUMENTS

| | | | |
|---|---|---|---|
| 4,848,180 | 7/1989 | Mills | 74/519 |
| 5,172,663 | 12/1992 | Fujiwara | 123/90.34 |
| 5,325,825 | 7/1994 | Schmidt et al. | 123/90.39 |
| 5,372,097 | 12/1994 | Joseph et al. | 123/90.36 |
| 5,566,652 | 10/1996 | Deppe | 123/90.35 |
| 5,657,726 | 8/1997 | Diggs | 123/90.36 |
| 5,967,105 | 10/1999 | Freeland | 123/90.43 |

FOREIGN PATENT DOCUMENTS

| | | |
|---|---|---|
| 4234868A1 | 4/1994 | Germany . |
| 19624413A1 | 1/1998 | Germany . |

*Primary Examiner*—Weilun Lo
*Attorney, Agent, or Firm*—Timothy D. MacIntyre

[57] ABSTRACT

A valve actuator for an engine includes a pivot socket having a dome with an improved lubrication passage. The actuator may be a finger follower with a body having spaced side walls connected adjacent opposite ends by first and second transverse webs. A cam follower, preferably a roller, having a cam engaging surface is supported on the side walls between the opposite ends of the body. The first web is engagable with a valve while the second web has a pivot socket with a dome having a generally spherical lower recess for engaging a pivot and a domed upper surface adjacent to the follower cam engaging surface. A lubrication passage extends through the dome from the lower recess to the upper surface. The passage includes an inverted inner channel formed in the recess and having upwardly converging sides meeting at a peak, and a connecting outer channel formed in the domed upper surface and having downwardly converging sides meeting at a valley. The peak and the valley are connected at adjoining ends of the inner and outer channels to form a restricting opening. The opening has an upper edge formed by the peak and a lower edge formed by the valley and connects the channels to form the lubrication passage. The passage is formed by oppositely moving dies that form the inner and outer channels and overlap at adjoining ends to form the opening without leaving a slug. A final sizing step is preferably included to finish the opening.

24 Claims, 5 Drawing Sheets

VALVE ACTUATOR WITH LUBRICATION PASSAGE AND METHOD OF FORMING

TECHNICAL FIELD

This invention relates to engine valve trains and, in particular, to the configuration of and method of forming a lubrication passage for spraying lubricant from a pivot socket to components of a valve actuating mechanism.

BACKGROUND OF THE INVENTION

It is well known in the engine valve train art to provide a valve actuator with a domed pivot socket such as a pivot recess of a finger follower or a push rod socket of a rocker arm. The pivot socket may communicate with a source of lubricating oil and include an opening for spraying oil from the socket through its dome for lubricating associated components of the valve mechanism. In a finger follower, for example, a hydraulic lash adjuster may act as a pivot about which the follower is actuated by a cam of a camshaft to open and close an associated valve of an engine. Lubrication of the cam and cam follower may be provided by spraying oil from the lash adjuster through an opening in a pivot socket of the finger follower into the camshaft compartment where it lubricates the cam, the follower, and the valve actuating pad or pallet of the finger follower.

With the currently common use of roller cam followers, it is possible to reduce the amount of lubricant supplied to the cam followers, and therefore reduce the amount of energy required by the oil pump for pumping lubricant in the engine. To accomplish this, in the most efficient manner, requires a lubricant passage designed for ease and accuracy of manufacture and arranged to aim lubricant directly at the surface of the roller follower, preferably near its line of contact with the associated cam.

SUMMARY OF THE INVENTION

The present invention provides a valve actuator, such as a finger follower or rocker arm in which a unique lubrication passage is provided through the dome of a generally spherical pivot socket. The lubrication passage may be formed in the process of stamping or pressing a formed metal valve actuator in which the lubrication passage is created in a lancing process by two cooperating dies. The dies may be integrated into the dies forming the actuator, as is preferred for accuracy and efficiency of manufacture. However, the dies could be separately made for use in a pivot socket of any suitable domed socket.

The passage includes an inverted inner channel formed in a generally spherical lower recess of the pivot, the channel having upwardly converging sides meeting at a peak, preferably having an arcuate edge. The inner channel connects with an outer channel formed in the domed upper surface of the pivot and having downwardly converging sides meeting at a valley, preferably having an arcuate lower surface. The peak and the valley are connected at adjoining ends of the inner and outer channels to form a restricted opening having an upper edge formed by the peak of the inner channel and a lower edge formed by the valley of the outer channel, so that the restricted opening connects the channels to form the continuous lubrication passage.

The passage is formed by two dies, one of which is raised from below to form the inverted inner channel and, the other of which is lowered from above to form the connecting outer channel. The peak and valley portions of the dies are overlapped slightly and engage at their adjoining ends to lance or, in effect, shear the metal in a slugless forming operation to form the restricted opening between the channels. In a preferred embodiment, this opening has a configuration similar to an eye socket with arcuate upper and lower sides leading to generally pointed and noncontinuous laterally spaced end points or edges. To finish the opening, it is preferably sized by inserting a sizing tool which smooths and compacts the edges of the opening and may be utilized to change its configuration as desired. Thus, the finished opening may be round, or oblong, or any other desired angular or curved configuration.

In a finger follower mechanism, in particular, the valley portion of the connecting outer channel may have a floor which initially runs parallel with the peak of the inner channel and then slopes upwardly in the direction of outward oil flow to direct the oil to a desired location on the exterior of a roller or other cam follower surface.

These and other features and advantages of the invention will be more fully understood from the following description of certain specific embodiments of the invention taken together with the accompanying drawings.

DESCRIPTION OF THE PREFERRED EMBODIMENT

Figure 1:
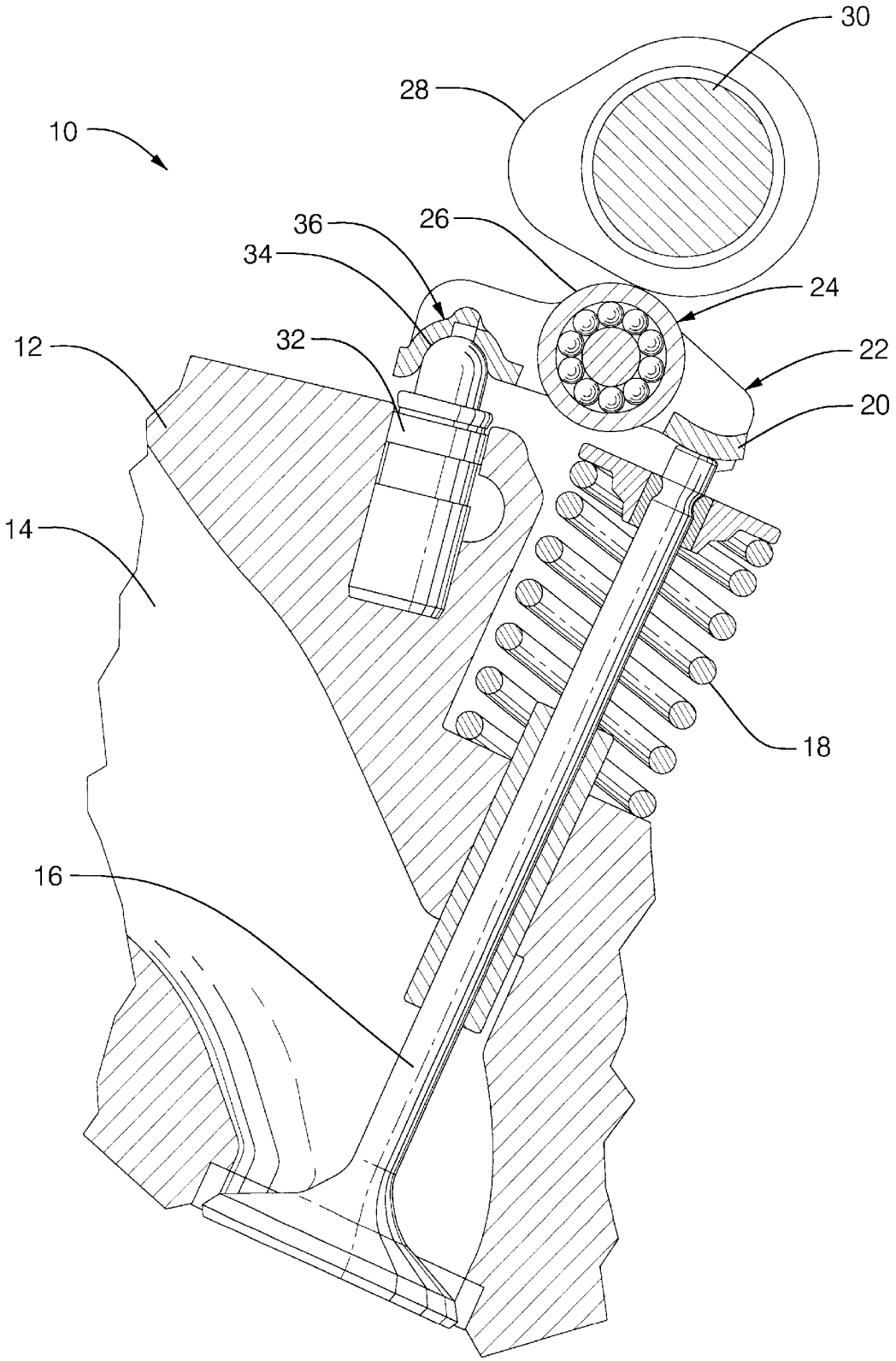
FIG. 1 is a cross-sectional view through a portion of an overhead cam engine, including a finger follower valve actuating mechanism having lubrication means in accordance with the invention.
Figure 2:
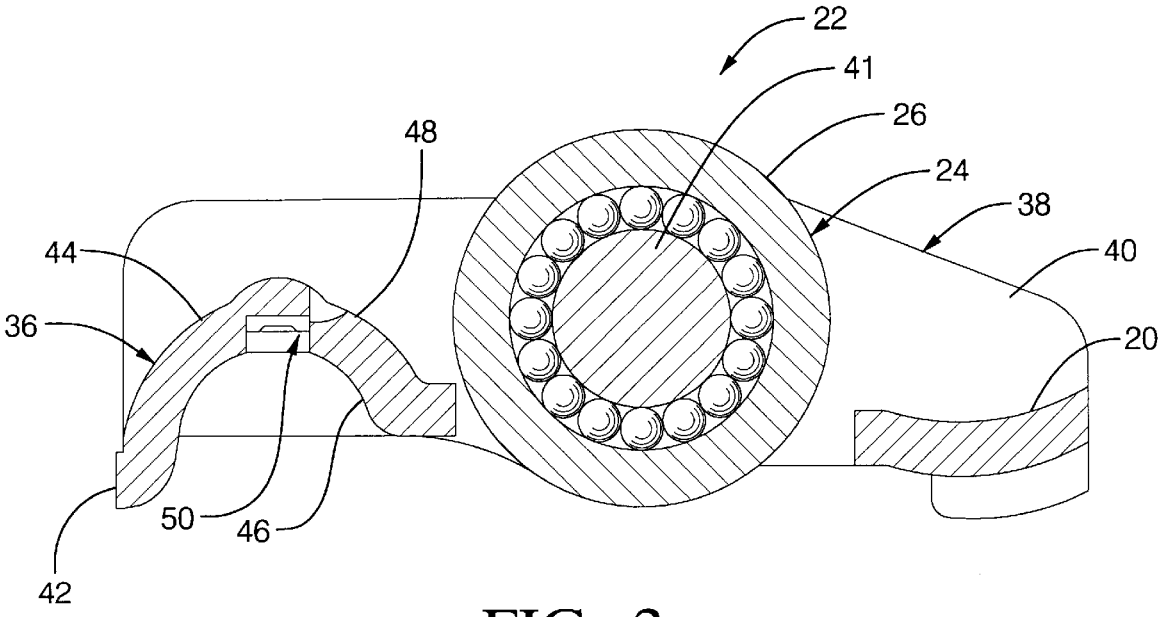
FIG. 2 is a cross-sectional view through the finger follower of FIG. 1.

Referring now to the drawings in detail, there is disclosed an exemplary application of the invention to a valve actuating mechanism of the finger follower type. In FIG. 1, numeral 10 generally indicates an overhead cam engine having a cylinder head 12, including an inlet or exhaust port 14 controlled by a valve 16 biased closed by a spring 18.

The valve 16 has a stem engaging a pallet or web 20 of a finger follower 22 supporting a roller cam follower 24 having an outer surface 26 engaged by an associated cam 28 of a camshaft 30. The cylinder head 12 supports a hydraulic lash adjuster 32 having a rounded end 34 on which a pivot socket 36 of the finger follower is seated.

Referring now to FIGS. 2–7, finger follower 22 includes a body 38, preferably formed by stamping or forming of a metal blank. Body 38 includes spaced side walls 40 supporting a pin 41 carrying the roller 24. The walls 40 are connected at opposite ends by first and second transverse webs 20, 42, respectively. Web 20, as previously mentioned, forms a pallet for engaging the stem of valve 16. Web 42, at the opposite end of the finger follower, includes the pivot socket 36 formed as a raised dome 44. The dome includes a generally spherical lower recess 46 and a domed upper surface 48 generally adjacent to the follower cam engaging surface 26. The dome 44 is provided with a lubrication passage, generally indicated by numeral 50 and best shown in FIGS. 3–7.

Figure 3:
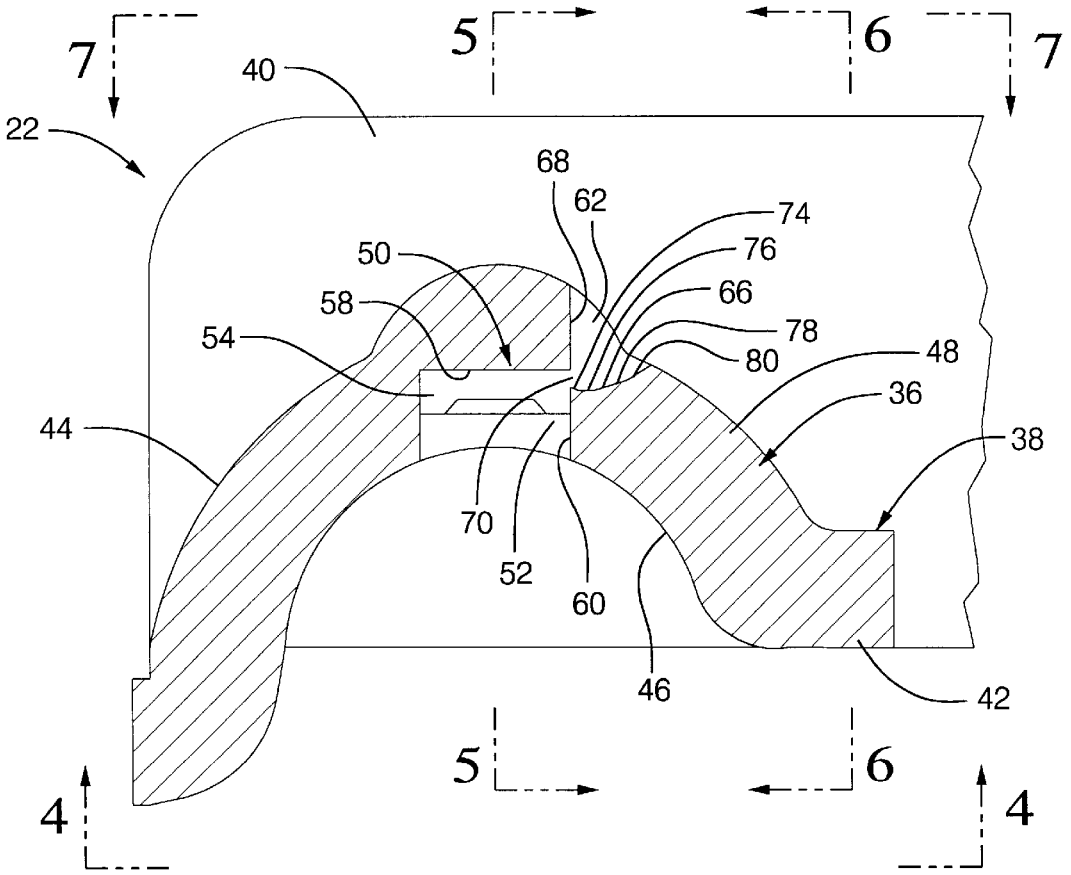
FIG. 3 is an enlarged cross-sectional view of the pivot socket portion of the finger follower of FIG. 2, showing the configuration of the formed lubrication passage.
Figure 4:
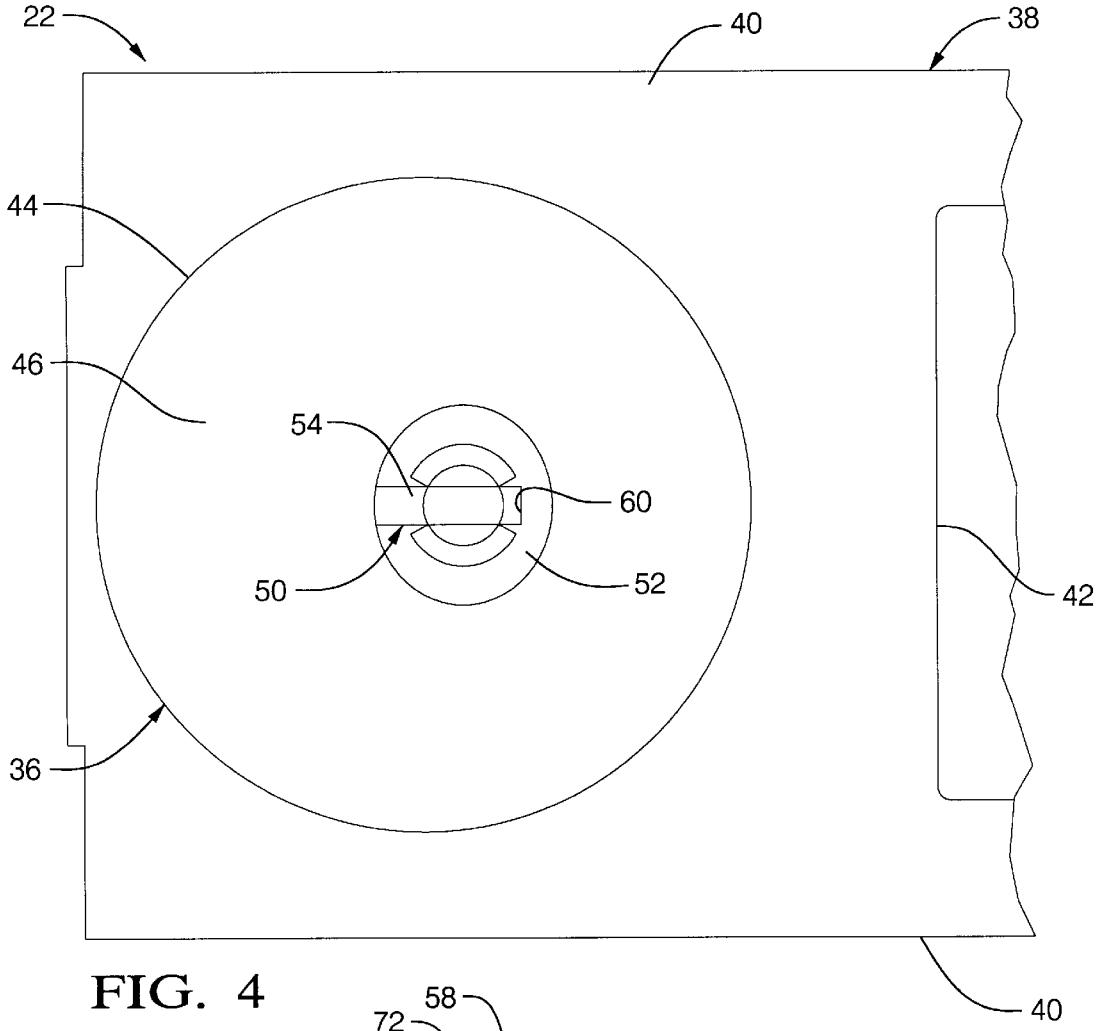
FIG. 4 is a bottom view of the pivot recess from the line 4—4 of FIG. 3.
Figure 5:
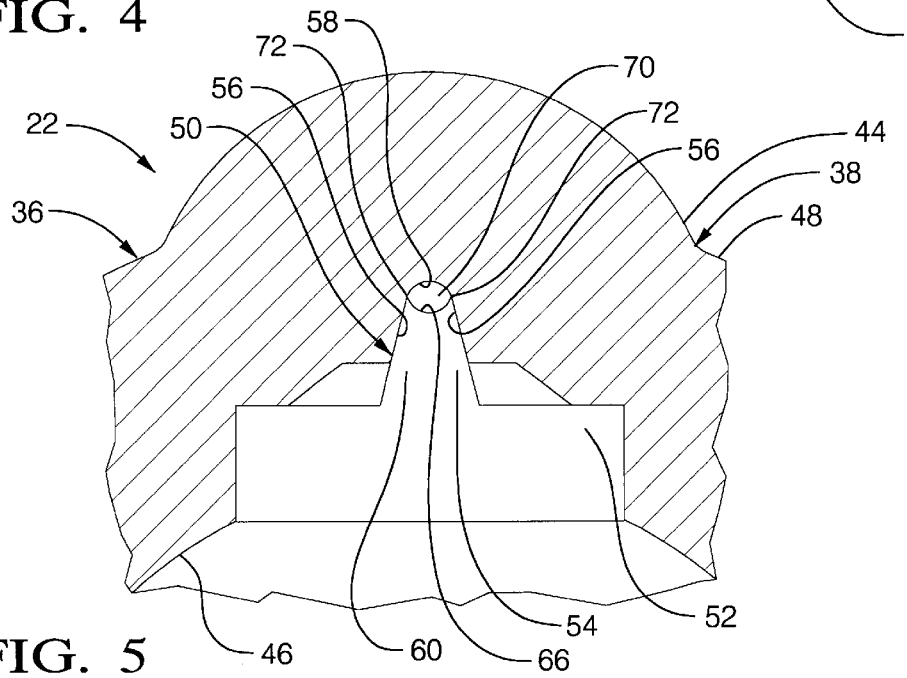
FIG. 5 is an enlarged cross-sectional view from the line 5—5 of FIG. 3, illustrating the internal configuration of the inverted inner channel and the adjoining opening.
Figure 6:
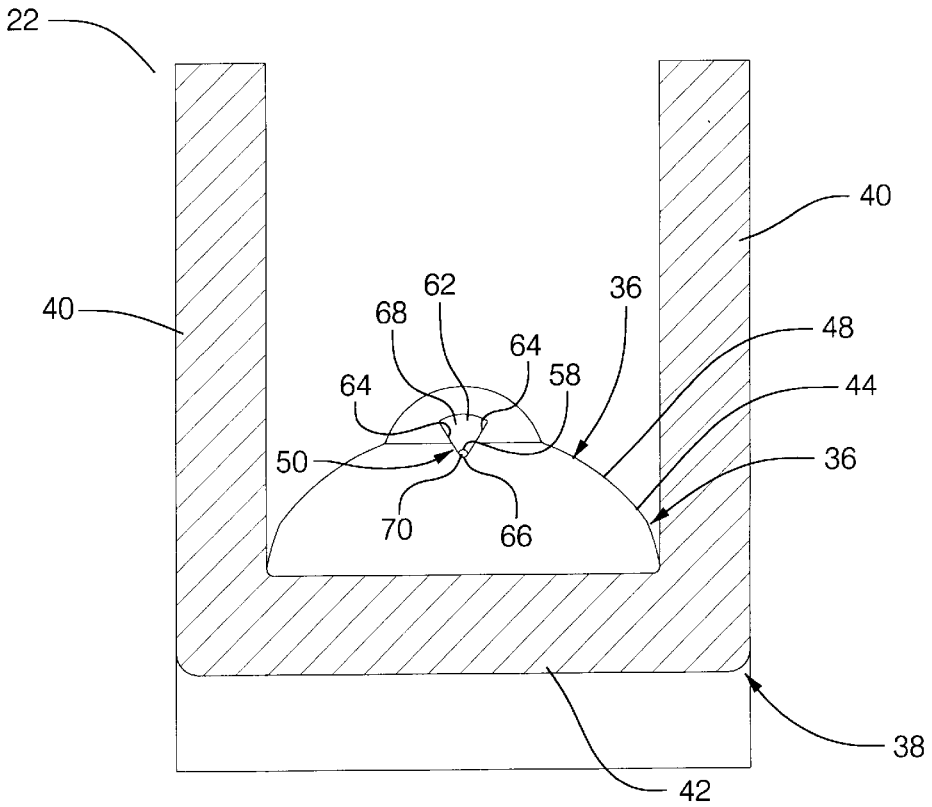
FIG. 6 is an enlarged cross-sectional view from the line 6—6 of FIG. 3, illustrating the external configuration of the connecting outer channel and the adjoining opening.
Figure 7:
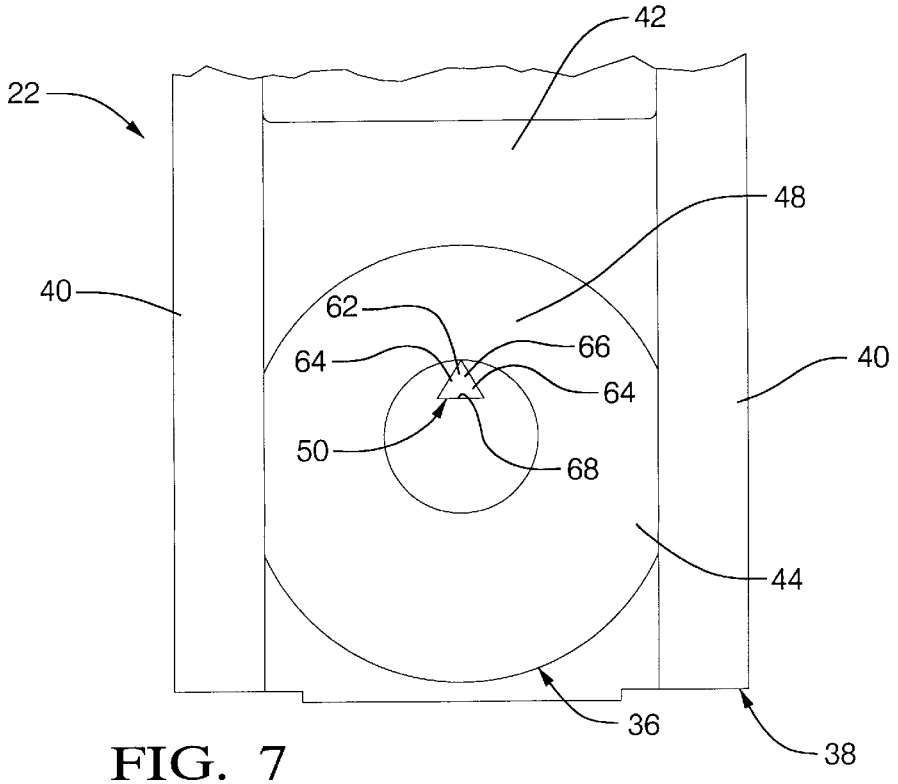
FIG. 7 is an enlarged top view from the line 7—7 of FIG. 3, illustrating the configuration of the outer channel.

Passage 50 optionally includes a generally cylindrical reservoir 52 extending upwardly from the lower recess 46 of the pivot socket 36 and merged into an inverted inner channel 54. The channel 54 is open downwardly to the reservoir 52 and the adjoining recess 46 from which lubricant is provided to the channel 54 through an opening (not shown) in the end 34 of the lash adjuster. Channel 54 further includes upwardly converging sides 56, as seen in FIG. 5, meeting at a peak 58 which is preferably curved in an arcuate configuration. The peak 58 extends horizontally, as shown in FIG. 3, although its operating position in an engine may be other than a horizontal position, and the peak extends to an inner edge 60. Passage 50 further includes a connecting outer channel 62 formed in the domed upper surface 48 and having downwardly converging sides 64, as shown in FIG. 6. The sides 64 meet at a valley 66, preferably formed in an arcuate configuration and extending to an outer edge 68 aligned with the inner edge 60 of the peak 58.

As is best seen in FIG. 3, the inverted inner channel 54 and the connecting outer channel 62 are connected at the inner edge 60 of the inner channel and the adjoining outer edge 68 of the outer channel by a restricting opening 70. As seen in FIGS. 5 and 6, opening 70 has its upper edge formed by the peak 58 of the inner channel and its lower edge formed by the valley 66 of the outer channel. The opening 70 preferably has a nonround configuration of dual noncontinuous arcs connecting at lateral edges in pointed or slightly rounded ends 72. In the configuration shown, the opening 70 is in its as formed or net shape configuration.

Referring particularly to FIG. 3, it is noted that the lower surface or valley 66 of the outer channel 62 includes a small lip 74 immediately adjacent the outer edge 68 of the channel. This lip is intended to be removed in a subsequent sizing step to be later described. An adjacent first portion 76 of the valley, next to the outer edge 68 and lip 74, is oriented generally parallel with the horizontal peak 58 of the inner channel 54. A second portion 78 of the valley, outwardly adjacent the first portion 76, slopes slightly upwardly, and a third portion 80 slopes more steeply upwardly. The sloped valley portions direct lubricant passing through the opening 70 at an upward angle toward the outer cam engaging surface 26 of the associated cam follower 24 for lubricating the cam follower and the associated cam, and, by the resulting spray, lubricating the pallet or web 20 which actuates the valve 16.

In order to form, in production, finger followers having a lubrication passage as heretofore described, the passage 70 is formed by what is termed a lancing operation by a pair of dies (not shown). For manufacturing efficiency and accuracy, the dies may be made as part of the dies used for forming the body of the finger follower. If desired, however, the dies could be made and used separately from the body forming process. In use, one of the dies is pressed upward into the lower recess to form the reservoir 52 and inner channel 54 with its arcuate peak 58. The other die is simultaneously pressed downward against the dome 44 to form the outer channel 62 which, as pictured, has a more or less triangular configuration. The dies are moved simultaneously against the follower dome and overlap slightly, rubbing together at the inner and outer edges 60, 68 sufficiently to form the opening 70 without leaving a loose slug of material to be subsequently removed from the part. Upon withdrawing of the dies, the opening and connecting channels are configured, as shown in FIGS. 1–6 of the drawings.

To complete finishing of the lubrication passage, a final step of sizing the opening 70 is preferably included in the process. The sizing step is accomplished by inserting a sizing tool (not shown), into the opening and forcing the sharp edges of the opening to expand slightly as they are smoothed. The sizing tool may be of any appropriate desired configuration, such as, circular, egg-shaped, or angular, if desired, to provide a final opening shape formed by the upper and lower edges of the adjoining channels 54, 62.

Figure 8:
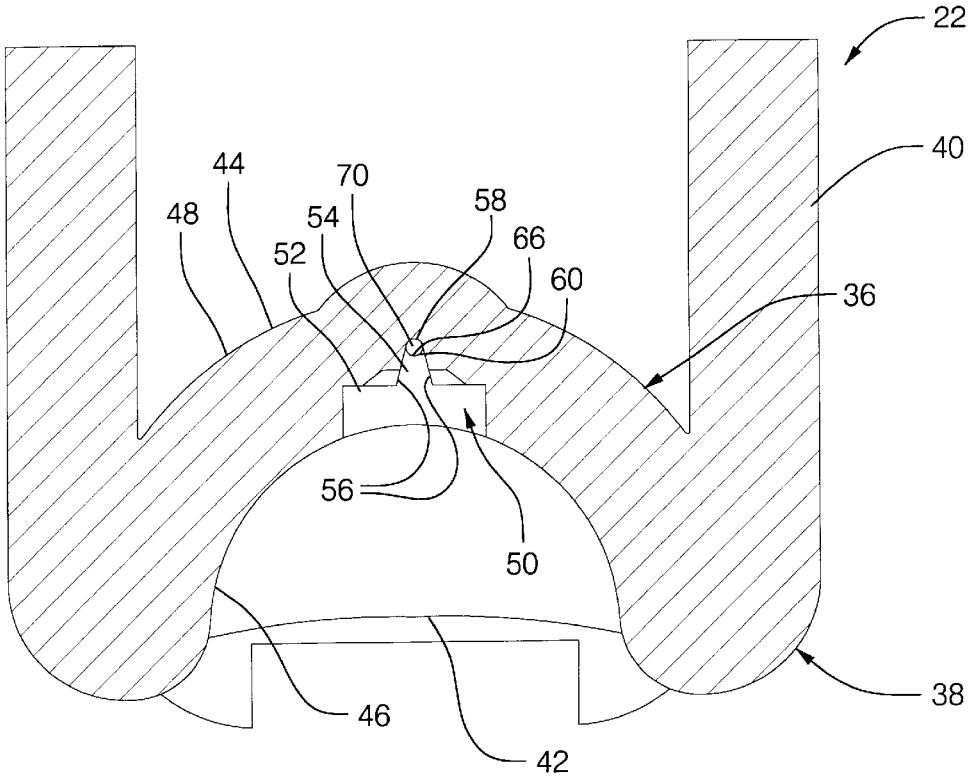
FIG. 8 is a cross-sectional view similar to FIG. 5 but illustrating an alternative embodiment of sized opening between the channels, wherein the opening is generally circular.

FIG. 8 illustrates one form of a sized opening 70 in follower 22, in which the opening has a generally circular configuration. This shape of opening is preferred from a manufacturing standpoint because of the ease of maintaining the sizing tools. However, if desired, an egg-shaped opening similar to that originally formed by the dual noncontinuous arcs may be provided by use of a special tool formed for the purpose. In any case, the forming of the opening 70 in a net shape by a lancing operation from simultaneously advanced dual dies which overlap and "kiss" one another, creates the slugless opening. The manufacturing process is both economical and capable of providing repetitive accurate openings which may be of a controlled small size. Smaller openings are useful in controlling the amount of lubricant passed through the openings in operation of an associated engine, and maintaining the necessary oil flow from the associated oil pump in a desired minimum range that reduces unnecessary pumping losses.

The lubrication passage of the present invention has been described by reference to a preferred embodiment in which the passage includes a connecting peak and valley, each having converging sides preferably meeting with arcuate configurations. However, it should be understood that other than arcuate shapes could be formed in the peak and valley of the connecting channels, including, for example, square cornered, triangular, and various forms of curved shapes. Thus, openings 70 of any desired shape may be used in and made in accordance with the invention and should be considered to be within the scope of the invention.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A valve actuator for use in an engine valve train, said actuator comprising:

a pivot socket including a dome having a generally spherical lower recess for engaging a pivot and a domed upper surface; and a lubrication passage through said dome from the lower recess to the upper surface, said passage including an inverted inner channel formed in the recess and having upwardly converging sides meeting at a peak, and a connecting outer channel formed in the domed upper surface and having downwardly converging sides meeting at a valley, said peak and said valley being connected at adjoining ends of the inner and outer channels to form a restricting opening having an upper edge formed by said peak and a lower edge formed by said valley and connecting the channels to form said lubrication passage.

2. A valve actuator as in claim 1 wherein said valley is nonlinear having a first portion adjacent said opening that is generally parallel with the peak of the inner channel and a second portion outwardly adjacent the first portion that slopes upwardly for directing lubricant in a desired direction.

3. A valve actuator as in claim 1 wherein said inner channel is formed in an upper end of an enlarged reservoir connecting said inner channel with said inner recess.

4. A valve actuator as in claim 1 wherein said restricting opening has a non-round configuration.

5. A valve actuator as in claim 1 wherein said restricting opening is formed by dual noncontinuous arcs.

6. A valve actuator as in claim 1 wherein said restricting opening has a generally circular configuration.

7. A valve actuator as in claim 1 wherein said actuator is a finger follower.

8. A finger follower for use in an engine valve train, said follower comprising:

a body including spaced side walls connected adjacent opposite ends by first and second transverse webs;

a cam follower mounted on said side walls between said opposite ends of the body and having a cam engaging surface;

said first web being operatively engagable with an associated valve of the valve train for actuating the valve;

said second web including a dome having a generally spherical lower recess for engaging a pivot and a domed upper surface adjacent to the follower cam engaging surface; and a lubrication passage through said dome from the lower recess to the upper surface, said passage including an inverted inner channel formed in the recess and having upwardly converging sides meeting at a peak, and a connecting outer channel formed in the domed upper surface and having downwardly converging sides meeting at a valley, said peak and said valley being connected at adjoining ends of the inner and outer channels to form a restricting opening having an upper edge formed by said peak and a lower edge formed by said valley and connecting the channels to form said lubrication passage.

9. A finger follower as in claim 8 wherein said cam follower is a roller rotatable on a pin supported between said spaced side walls.

10. A finger follower as in claim 8 wherein said body is a stamping.

11. A finger follower as in claim 8 wherein said valley is nonlinear having a first portion adjacent said opening that is generally parallel with the peak of the inner channel and a second portion outwardly adjacent the first portion that slopes upwardly for directing lubricant toward said cam engaging surface of the cam follower.

12. A finger follower as in claim 11 wherein said valley includes a third portion outwardly adjacent the second portion and having a steeper upward slope for directing lubricant toward the cam follower.

13. A finger follower as in claim 8 wherein said inner channel is formed in an upper end of an enlarged reservoir connecting said inner channel with said inner recess.

14. A finger follower as in claim 8 wherein said restricting opening has a non-round configuration.

15. A finger follower as in claim 8 wherein said restricting opening is formed by dual non-continuous arcs.

16. A finger follower as in claim 8 wherein said restricting opening has a generally circular configuration.

17. A method of making a lubrication passage in a valve actuator including a pivot socket having a dome with a generally spherical lower recess and a dome shaped upper surface, said method comprising:

forming an inverted inner channel connecting with an upper portion of said lower recess, said inner channel having upwardly converging sides meeting at a peak;

forming a connecting outer channel in said dome shaped upper surface of the dome, said outer channel having downwardly converging sides meeting at a valley;

said peak and said valley being connected at adjoining ends to form a restricting opening having an upper edge formed by said peak and a lower edge formed by said valley, said opening connecting the channels to form said passage without leaving a slug of material between the channels that requires removal to form the opening.

18. A method as in claim 17 wherein said inner and outer channels are formed simultaneously by oppositely moving dies.

19. A method as in claim 17 and including the step of sizing said opening after forming of the inner and outer channels, said sizing step being performed by insertion of a sizing tool into said opening to smooth and enlarge the edges thereof.

20. A method as in claim 19 wherein said sizing step modifies the size and configuration of said opening.

21. A method of making a lubrication passage in a finger follower including a web having a dome with a generally spherical lower recess and a dome shaped upper surface, said method comprising:

forming an inverted inner channel connecting with an upper portion of said lower recess, said inner channel having upwardly converging sides meeting at a peak;

forming a connecting outer channel in said dome shaped upper surface of the dome, said outer channel having downwardly converging sides meeting at a valley;

said peak and said valley being connected at adjoining ends to form a restricting opening having an upper edge formed by said peak and a lower edge formed by said valley, said opening connecting the channels to form said passage without leaving a slug of material between the channels that requires removal to form the opening.

22. A method as in claim 21 wherein said inner and outer channels are formed simultaneously by oppositely moving dies.

23. A method as in claim 21 and including the step of sizing said opening after forming of the inner and outer channels, said sizing step being performed by insertion of a sizing tool into said opening to smooth and enlarge the edges thereof.

24. A method as in claim 23 wherein said sizing step modifies the size and configuration of said opening.

* * * * *

UNITED STATES PATENT AND TRADEMARK OFFICE

CERTIFICATE OF CORRECTION

PATENT NO : 6,070,561

DATED : June 6, 2000

INVENTOR(S) : Greene et al.

It is certified that error appears in the above-identified patent and that said Letters Patent are hereby corrected as shown below:

On the title page, item [73]

Please delete "General Motors Corporation, Detroit, Mich." from the United States Patent document and insert therefor --Delphi Technologies, Inc. Troy, Michigan and Okay Industries, Inc. New Britain, Connecticut 06050--.

Signed and Sealed this

Seventeenth Day of April, 2001

*Attest:*

*Attesting Officer*

Nicholas P. Godici

NICHOLAS P. GODICI

*Acting Director of the United States Patent and Trademark Office*